US009016268B2

(12) United States Patent
Leven

(10) Patent No.: US 9,016,268 B2
(45) Date of Patent: Apr. 28, 2015

(54) ADJUSTABLE MECHANICAL VIBRATION LIMITING AND ABSORBING APPARATUS

(75) Inventor: William L. Leven, Lancaster, CA (US)

(73) Assignee: Leven Industries, Lancaster, CA (US)

( * ) Notice: Subject to any disclaimer, the term of this patent is extended or adjusted under 35 U.S.C. 154(b) by 122 days.

(21) Appl. No.: 12/948,578

(22) Filed: Nov. 17, 2010

(65) Prior Publication Data

US 2011/0120439 A1 May 26, 2011

Related U.S. Application Data

(60) Provisional application No. 61/281,456, filed on Nov. 18, 2009.

(51) Int. Cl.
*F41B 5/00* (2006.01)
*F41B 5/14* (2006.01)

(52) U.S. Cl.
CPC ..... *F41B 5/1426* (2013.01)

(58) Field of Classification Search
CPC ..... F41B 5/1426
USPC ..... 124/89, 86, 88
See application file for complete search history.

(56) References Cited

U.S. PATENT DOCUMENTS

| | | | | |
|---|---|---|---|---|
| 3,412,725 | A | 11/1968 | Hoyt, Jr. | |
| 3,589,350 | A | 6/1971 | Hoyt, Jr. et al. | 124/24 |
| 4,132,825 | A | 1/1979 | Hahn | 428/311 |
| 4,509,730 | A | 4/1985 | Shtarkman | 267/35 |
| 4,615,327 | A | 10/1986 | Saunders | 124/89 |
| 4,660,538 | A * | 4/1987 | Burgard | 124/89 |
| 5,219,051 | A | 6/1993 | Davis | 188/378 |
| 5,975,070 | A * | 11/1999 | Sands | 124/89 |
| 6,076,512 | A | 6/2000 | Thielen et al. | 124/25.6 |
| 6,382,201 | B1 * | 5/2002 | McPherson et al. | 124/89 |
| 6,802,307 | B2 | 10/2004 | Leven | 124/89 |
| 7,213,590 | B2 * | 5/2007 | Pellerite | 124/89 |
| 2009/0260609 | A1 * | 10/2009 | Park | 124/23.1 |

* cited by examiner

*Primary Examiner* — Melba Bumgarner
*Assistant Examiner* — Amir Klayman
(74) *Attorney, Agent, or Firm* — DLA Piper LLP (US)

(57) ABSTRACT

An adjustable mechanical vibration limiting and absorbing device for an archery bow including a hollow housing and two groups of elastomer washers provided in the hollow housing with a means for preventing the first group from advancing out of the hollow housing and separating the first group from the second group. In addition, a fastener extends through the center of the first and second groups of elastomer washers and a lock nut and weight are provided on the projecting end of the fastener.

7 Claims, 2 Drawing Sheets

ADJUSTABLE MECHANICAL VIBRATION LIMITING AND ABSORBING APPARATUS

BACKGROUND OF THE INVENTION

1. Field of Invention

The invention relates to devices and apparatuses for limiting and absorbing mechanical vibration, particularly devices utilized in conjunction with archery bows.

2. Prior Art

In the prior art there exists several different kinds of devices for limiting and absorbing vibration generated by an archery bow during the shooting of an arrow. However, such devices are generally of fixed characteristics. Therefore, if one wants to adjust the amount of vibration which is limited or absorbed, one must own or use several different mechanical vibration limiting and absorbing devices. Such devices can be found in the patents as follows:

| | |
|---|---|
| 3,412,725 | 3,589,350 |
| 4,132,825 | 4,509,730 |
| 4,615,327 | 5,219,051 |
| 6,076,512 | 6,802,307 |

SUMMARY OF THE INVENTION

It is generally obvious that the present invention to overcome the disadvantages of the prior art.

In particular, it is a particular object of the present invention to provide an adjustable mechanical vibration limiting and absorbing device which can be adjustable to any weight configuration and mass that the purposes of reducing the vibration of archery bow during the shooting of an arrow.

It is still another object to the present invention to provide an adjustable mechanical vibration limiting and absorbing device which is small in size and profile and easy and low in cost to manufacture.

The above mentioned features and objects of the present invention can be accomplished by a unique adjustable mechanical vibration limiting and absorbing apparatus including a hollow housing, first and second groups of elastomer washers provided in said hollow housing, a means for separating the first group from the second group and preventing the first group from advancing out of the housing, a fastener extending through a hole in the elastomer washers and projecting out of the housing, a lock nut provided on the projecting end of the fastener and engaging with one side of the second group of elastomer washers and a weight provided on the projecting end of the fastener and adjacent to the lock nut whereby turning the lock nut and the weight provided on the fastener the vibration limiting and absorbing characteristics and be varied.

BRIEF DESCRIPTION OF THE DRAWINGS

The above mentioned features and objects of the present invention would become apparent to one ordinarily skilled in the art based upon the following description taken in conjunction with the accompanying drawings wherein like referenced elements are designated by the same reference character and in which.

DETAILED DESCRIPTION OF THE INVENTION

Figure 1:
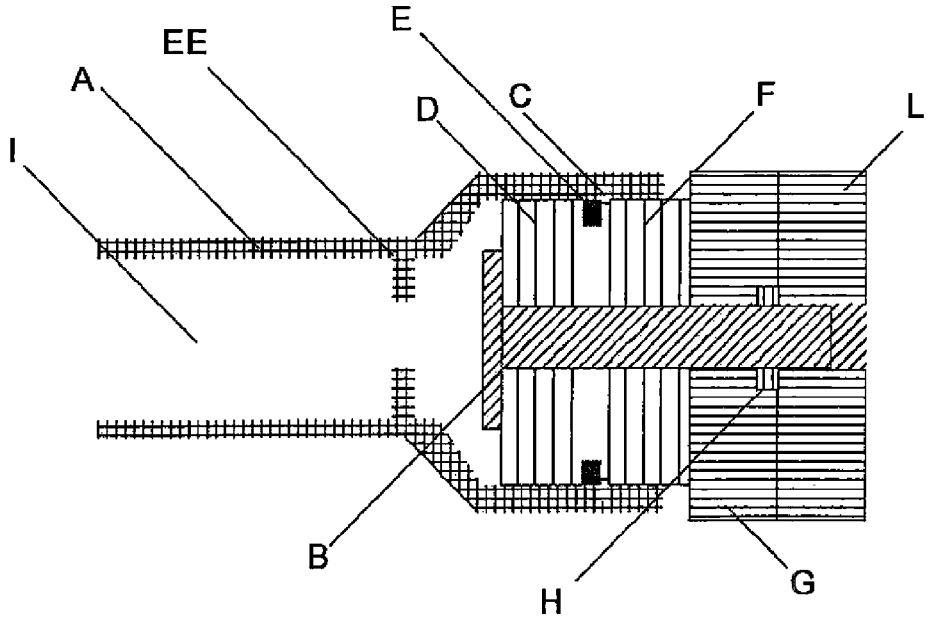
FIG. 1 is a cross-sectional view of a first embodiment of the present invention.

Referring to FIG. 1, shown therein as a first embodiment of the adjustable mechanical vibration limiting and absorbing device of the present invention. The device is made up of a hollow housing A which can be made out of a metal or molded out of a durable plastic material. The housing A should be as light as possible, but yet still keep its structural integrity. Accordingly, it should be made out of a material such as aluminum or a high density plastic and at least in this first embodiment is cylindrical.

Provided inside the housing A is a first group of internal elastomeric washers D. These internal elastomeric washers D are prevented from moving forward out of the housing A by means of a detent or stop E. The detent or stop E may be manufactured into the housing or may be a removable clip which fits into a groove in the interior surface of the hollow housing A. The group of elastomeric washers D supports the head end of a threaded fastener B which is fitted through a hole in the elastomeric washers D. The fastener B is allowed movement relative to the washers D.

A second group of elastomeric washers F are also provided in the housing A and fitted onto the fastener B. A weight L and a lock nut G are further threaded onto the projecting end of the fattener B. The elastomeric washers F supports the weight L and the locking nut G and further isolates the metal parts. The elastomeric washers D and F are made from an elastomer having a hardness on the A shore hardness scale between 25 and 90. The elastomeric washes used may be all of the same hardness and for can be varied and mixed based upon the application and the user.

Figure 4:
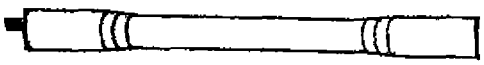
FIG. 4 is a rod for attaching to an archery bow which incorporates the present invention.

The housing A is provided with a small diameter part I and a large diameter part into which the elastomeric washers D and F are fitted. Between the large diameter portion of the housing A and the small diameter portion I is provided a second detent or stop EE. This detent or stop EE stops the stabilizer for an archery bow onto which the device is fitted from contacting the fastener B and/or the washers D. Such a stabilizer is shown in FIG. 4 with this first embodiment fitted thereon.

In operation, by tightening the weights L and lock nut G onto the fastener B, the elastomeric washers D and F are compressed. While being compressed, the washers D and F also expand against the interior surface of the housing A. As a result of being compressed and also being expanded against the interior surface of the housing A, the mechanical vibration limiting and absorbing characteristics of the device can be varied. As a result, the tension or stiffness can be adjusted by tightening or loosening the tension on the washers to change the amount of movement of any weights attached to the device.

Figure 2:
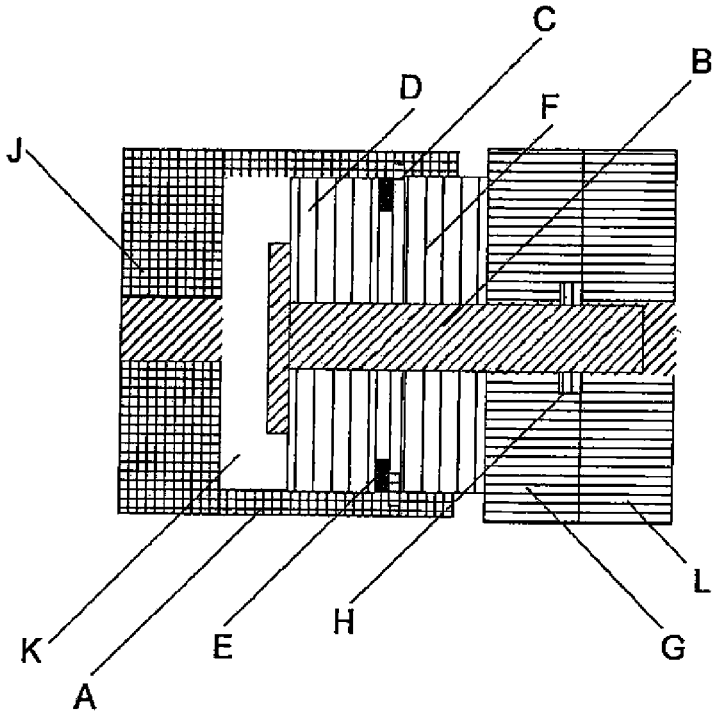
FIG. 2 is a cross-section of a second embodiment of the present invention.

Referring to FIG. 2, shown therein is a second embodiment of the present invention. This second embodiment is meant as a cap which can be threaded directly onto the riser of a bow or onto the end of a stabilizer rod utilized together with an archery bow. As a result, this device only differs from the first embodiment in that it includes a threaded base J which screws onto the end of a stabilizer or onto the riser of an archery bow. Still further, housing A includes a cavity K into which the first and second group of washers D and F, stop E and fastener B are provided. Still further and in some applications a removable clip C can be utilized in conjunction with the detent E.

In operation, this second embodiment functions in substantially the same way as the first embodiment.

Figure 3:
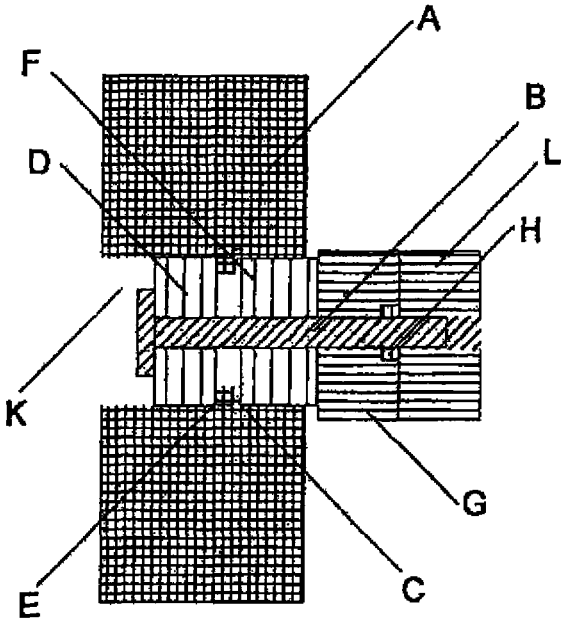
FIG. 3 is a cross-section of a third embodiment of the present invention.

Referring to FIG. 3, shown therein is a third embodiment of the present invention. This third embodiment is substantially the same in principle and parts as that of the embodiments one and two except that the housing is a cavity formed in an accessory. In other words, a cavity K could be formed in the riser of the archery bow and this third embodiment provided therein.

It should be apparent to those skilled in the art that the above described embodiments are but a few of the many possible embodiments of the present invention which could be made without departing from the spirit and scope of the present invention. Such variations would be to provide metal and/or hard plastic washers together with the elastomeric washers groups D and F and using a lock nut without a weight or a weight without a lock nut.

The invention claimed is:

1. An adjustable mechanical vibration limiting and absorbing apparatus comprising:

a hollow housing;

a fastener comprising a head end contained within the hollow housing and a projecting end extending outside of the hollow housing; and components arranged in order as follows from the head end of the fastener to the projecting end of the fastener:

a first group of at least one elastomer washer provided in said housing and fitted onto the fastener in contact with the head end;

a means for preventing said first group of at least one elastomer washer from advancing outside of the housing;

a second group of at least one elastomer washer fitted onto said fastener;

and a weight provided outside of the housing fitted onto said projecting end of said fastener;

wherein the weight is turned and tightened outside of the housing on the fastener, without removing any of the components from within the housing, to cause the first and second groups of at least one elastomer washer to compress and to expand against an interior surface of the housing, and to thereby vary mechanical vibration limiting and absorbing characteristics of the apparatus.

2. The adjustable mechanical vibration limiting and absorbing apparatus according to claim 1 wherein said housing is cylindrical.

3. The adjustable mechanical vibration limiting and absorbing apparatus according to claim 1, wherein the means for preventing the first group of elastomer washers from advancing outside of the housing is a detent or a stop.

4. The adjustable mechanical vibration limiting and absorbing apparatus according to claim 3, wherein the detent or stop is a removable clip that fits into a groove in the interior surface of the housing.

5. The adjustable mechanical vibration limiting and absorbing apparatus according to claim 1, wherein the first and second groups are comprised of elastomer washers having a hardness on the A shore hardness scale between 25 and 90.

6. The adjustable mechanical vibration limiting and absorbing apparatus according to claim 1, wherein the housing comprises a large diameter part that receives the fastener and a small diameter part that receives a stabilizer.

7. The adjustable mechanical vibration limiting and absorbing apparatus according to claim 6, further comprising a detent or stop provided within the small diameter part of the housing for stopping the stabilizer.

* * * * *